US005445925A

United States Patent [19]

Marsden et al.

[11] Patent Number: 5,445,925

[45] Date of Patent: Aug. 29, 1995

[54] METHOD OF FORMING A PHOTOGRAPHIC COLOR IMAGE

[75] Inventors: Peter D. Marsden, North Harrow; Gareth B. Evans, Potten End, both of England

[73] Assignee: Eastman Kodak Company, Rochester, N.Y.

[21] Appl. No.: 224,222

[22] Filed: Apr. 7, 1994

[30] Foreign Application Priority Data

Apr. 13, 1993 [GB] United Kingdom ..... 9307502.6

[51] Int. Cl.[6] ..... G03C 7/00; G03C 7/407; G03C 7/42

[52] U.S. Cl. ..... 430/393; 430/364; 430/367; 430/373; 430/414; 430/421; 430/427; 430/430; 430/470; 430/943

[58] Field of Search ..... 430/364, 367, 373, 393, 430/427, 430, 943, 414, 421, 470

[56] References Cited

U.S. PATENT DOCUMENTS

| | | | |
|---|---|---|---|
| 3,264,107 | 8/1966 | von Wartburg | 430/393 |
| 4,088,486 | 5/1978 | Bissonette | 430/393 |
| 5,171,658 | 12/1992 | Fyson | 430/414 |
| 5,354,647 | 10/1994 | Fyson | 430/393 |

FOREIGN PATENT DOCUMENTS

| | | | |
|---|---|---|---|
| 2527398 | 1/1976 | Germany | 430/943 |
| 52-30847 | 8/1977 | Japan | 430/461 |
| 54-1028 | 1/1979 | Japan | 430/367 |

OTHER PUBLICATIONS

*Research Disclosure,* No. 14846, Aug. 1976, pp. 45–48, by V. L. Bissonette.

*Research Disclosure,* No. 19208, Apr. 1980, pp. 136–137, Anonymous.

T. H. James, ed., "The Theory of the Photographic Process", 4th ed., New York, Macmillan, 1977, pp. 448–449, 460.

K. Keller, ed., "Science and Technology of Photography", New York, VCH, 1993, pp. 107, 245.

*Primary Examiner*—Janet C. Baxter

*Assistant Examiner*—J. Pasterczyk

*Attorney, Agent, or Firm*—Sarah Meeks Roberts; J. Lanny Tucker

[57] ABSTRACT

A color image can be obtained from a color photographic element by multiple color development steps. The first color development is carried out in the usual manner after imagewise exposure. The second color development step is carried out after bleaching with a rehalogenating bleaching agent, and is used to develop only rehalogenated silver halide. This specific development is possible by either using a chloride rehalogenating agent in the bleaching solution, using a sulfite fixing agent before bleaching, or by fogging the element between bleaching and the second color development step.

17 Claims, No Drawings

METHOD OF FORMING A PHOTOGRAPHIC COLOR IMAGE

FIELD OF THE INVENTION

This invention relates to a method of forming a photographic colour image.

BACKGROUND OF THE INVENTION

It is well known that photographic colour images can be obtained by treating an imagewise exposed silver halide material containing one or more colour couplers with a colour developing solution. Colour developing agent oxidised in the presence of silver halide development couples with the colour coupler to form a dye image.

In most such processes the image-bearing silver halide material is treated with a bleach solution which oxidises the silver image, often back to a silver halide, and a fix solution which removes the unexposed silver halide and silver salt formed by the bleach from the material. A combined bleach/fix solution is alternatively used.

In the desire to use less silver in photographic materials it has been proposed that low silver-containing silver halide materials can be processed by a redox amplification method whereby the dye is produced in the vicinity of very small amounts of silver image which acts as a catalyst.

There are problems in operating a redox amplification system concerned with the stability of the solutions used while low silver materials will not provide the desired Dmax for the images produced without a redox amplification process.

PROBLEM TO BE SOLVED BY THE INVENTION

The present invention provides a method of obtaining colour images using photographic materials containing less silver than normal but which can provide fully satisfactory colour images without necessarily using a redox amplification system. In some embodiments it allows the use of bleach baths based on hydrogen peroxide which is environmentally preferable to current widely used bleach baths. The use of such bleach baths is not normally possible because currently used silver halide levels are too high.

SUMMARY OF THE INVENTION

According to the present invention there is provided a method of forming a photographic colour image from an imagewise exposed photographic silver halide material containing at least one dye image-forming colour coupler which comprises the step of treating the material with a colour developer composition characterised in that the colour developed photographic material is subjected to at least one rehalogenating bleach followed by a further colour development step in which only the rehalogenated silver halide is developed.

ADVANTAGEOUS EFFECT OF THE INVENTION

The present invention:

1. Allows the use of a low silver coating weight to form images of normal density without the chemical instability problems of a redox amplification process.

2. Enables the use of a peroxide bleach which is environmentally desirable,

3. Enables the use of low silver coating weight materials without the need for more efficient couplers than those currently used.

4. Does not necessarily need a specially designed or complex processor apparatus.

DETAILED DESCRIPTION OF THE INVENTION

In one embodiment of the present invention the photographic material is subjected to a fix bath before the rehalogenating bleach bath. Without this fix bath it would be desirable to ensure that the rehalogenated silver halide and the existing silver halide could be easily discriminated by the second colour developer bath. One way of doing this would be for the photographic material to have silver bromide or bromoiodide emulsions and for the rehalogenating bath to form silver chloride. The so-formed silver chloride would be more developable than the original halide as is well understood.

Preferably a fix bath is introduced between the first development step and the bleach step. The preferred fixer comprises sulphite ions. For example the fix bath may comprise water containing 12–190, preferably 20–125 and particularly 30–100 g ions/litre of sulphite. Preferably sodium or potassium sulphite is used. Fixers containing significant amounts of thiosulphate ions are unsuitable in the process of the present invention.

The rehalogenating bleach bath may be based on a ferricyanide or ferric EDTA bleach or, preferably, a peroxide bleach. The peroxide bleach solution may further comprise a base, a halide (preferably a chloride) and optionally a metal-chelating compound. It preferably has a pH above 5, preferably in the range 6 to 9 and contains from 25 to 100 ml, preferably from 30 to 65 ml, 30% hydrogen peroxide solution per litre. Preferably the silver halide emulsions of the photographic material are silver chloride, for example at least 85 mole percent silver chloride. Preferably the material has low total silver halide coating levels, for example levels below 500 mg/m$^2$, preferably below 300 mg/m$^2$ and particularly below 150 mg/m$^2$ (as silver).

Between the rehalogenation and before the next image forming step there is preferably a fogging step either by light or chemical means to render the rehalogenated silver more rapidly developable.

The additional rehalogenation and colour development steps may be repeated any number of times until the desired dye density is achieved. In addition to the processing steps described above there may be added other processing steps, for example, appropriate stop, wash, fix and stabilise steps.

The colour developer solution for the second colour development step may be same as that used for the first colour development or it may be different. If the same, the material may be passed to the tank containing the first colour developer or to a different tank containing the same or a different solution. Apparatus wherein the material can be recycled to a previous bath is described in our copending U.K. Applications 93007504.2; 93007505.9; 93007513.3 and 93007514.1 all filed Apr. 13, 1993.

Before subjecting the material to the second colour development step, it may be desirable to remove any bleaching agent, e.g. hydrogen peroxide, from the material. This can be done by washing in water or a sulphite or metabisulphite solution.

In a particular embodiment the photographic material is subjected to the following processing steps:

1. A first chromogenic development stage forming a dye image,
2. A fixing stage to remove undeveloped silver halide,
3. A bleach stage to convert the silver image into silver halide,
4. A second chromogenic development stage to produce a second amount of dye,
5. A bleach stage to convert silver into a solubilisable form,
6. A fix stage to remove silver salts from the image, and
7. A wash or stabilisation stage.

Steps 3 and 4 could be repeated to provide more dye production from the same amount of silver. For example a coating of 377 mg/m$^2$ silver halide (half the normal laydown) could be processed using the above cycle. Two chromogenic stages produce the required amounts of dye for satisfactory contrast and density range. Alternatively if the bleach/develop cycle is repeated to give 5 development stages, the coated silver can be reduced to about 161 mg/m$^2$.

Step 2 could involve two baths, one to provide silver solubilising agent and a second to ensure adequate removal of dissolved silver. Preferably the fixing agent is sodium sulphite which avoids the use of fixers such as thiosulphate which can lengthen the time needed for bleaching.

Step 4 proceeds more readily if the silver halide formed on bleaching has been fogged. This can be done by exposure to light or by a chemical added in a separate stage or in the second developer solution.

The rehalogenating bleach may comprise known compositions based on ferricyanides, persulphates, and metal complexes of EDTA and the like polycarboxylic acid chelating agents.

Examples of process cycles using the stages described can include wash stages in between the stages described to reduce the carry-over of chemicals from one bath to another by the photographic layers. Without such wash stages it is likely that some redox amplification will take place.

Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution (or a combined developer-amplifier) to form a dye image. The developer-amplifier solution contains a colour developing agent and an oxidising agent which will oxidise the colour developing agent in the presence of the silver image which acts as a catalyst. Oxidised colour developer reacts with a colour coupler to form the image dye. The amount of dye formed depends on the time of treatment or the availability of colour coupler and is less dependent on the amount of silver in the image as is the case in conventional colour development processes. Examples of suitable oxidising agents include peroxy compounds including hydrogen peroxide and compounds which provide hydrogen peroxide, eg addition compounds of hydrogen peroxide; cobalt (III) complexes including cobalt hexammine complexes; and periodates. Mixtures of such compounds can also be used. A particular application of this technology is in the processing of silver chloride colour paper, especially such paper with low silver levels.

Examples of process cycles using the stages described without intermediate wash steps involve contact of the photographic material already containing either developer composition with a subsequent peroxide bleach bath, or paper already containing peroxide bleach with a subsequent developer bath. In both cases the paper will contain simultaneously peroxide and developer and some redox amplification image formation would be expected.

If the process takes place in a processing machine it is preferred to use minimal volumes in the application devices. Such apparatus is described in our PCT application nos. EP91/00266, EP91/00256 and EP91/00785. Where a developer is likely to become contaminated by peroxide, this peroxide can be destroyed by the use of relatively large amounts of antioxidants, particularly sulphite in the developer. For developer-contaminated peroxide bleach solutions, the developing agent can be oxidised and removed by a suitable scavenging agent.

The present method may employ photographic materials, processing compositions and methods set out in Research Disclosure Item 308119, Deccember 1989 published by Kenneth Mason Publications, Emsworth, Hants, United Kingdom.

The following Examples are included for a better understanding of the invention.

EXAMPLE 1

Two multilayer colour photographic papers were coated(12.5 cm web), similar to currently available silver chloride colour paper. The silver laydowns were as follows:

| Expt. | | Cyan mg/m$^2$ | Magenta mg/m$^2$ | Yellow mg/m$^2$ | TOTAL mg/m$^2$ |
|---|---|---|---|---|---|
| (A) | Coating 1 (control) | 198 | 281 | 283 | 762 |
| (B) | Coating 2 | 104 | 140 | 99 | 343 |

One strip from coating 1 and two strips from coating 2 were exposed to a four colour wedge, (giving red, green, blue and neutral exposures) for 0.1 sec on a sensitometer, utilising a filter pack containing a WRATTEN 2B plus 60M and 60Y cc filters.

The following processing solutions were prepared:

| | | |
|---|---|---|
| (1) | Working RA4 developer | |
| | -700 ml developer replenisher | |
| | -275 ml Demineralised water | |
| | - 25 ml starter solution | |
| | 1000 ml | |
| (2) | RA4 Bleach fix solution | |
| (3) | 2% Acetic acid solution | |
| (4) | Peroxide bleach | |
| | Demineralised water | 500 ml |
| | 100 Vol (30%) Hydrogen Peroxide | 50 ml |
| | KCl | 0.5 g |
| | $KHCO_3$ | 25 g |
| | 1-hydroxyethylidene-1,1'-diphosphonic acid | 1 ml |
| | diethyltriamine-penta-acetic acid | 1 ml |
| | -Demin water to 1 LITER | |
| | -pH 8.0 | |
| (5) | Sulphite Fix | |
| | Demin water | 500 ml |
| | Glacial acetic acid | 50 ml |
| | 50% NaOH solution | 70 ml |
| | Sodium Sulphite | 100 g |
| | -Demin water to 1 LITER | |

-continued

-pH 7.0

The exposed strips were processed as follows on a KODAK H11 DRUM processor.

Process for control strips (coatings 1 & 2)

| | | | | |
|---|---|---|---|---|
| 1 | Soln (1) | RA4 developer | 45" 35° C. | (Drum 1) |
| 2 | Soln (3) | Acetic stop | 30" | (Drum 2) |
| 3 | | WASH | 30" | |
| 4 | Soln (2) | RA4 bleach-fix | 60" | |
| 5 | | WASH | 60" | |

The processed strips were read using an X-Rite reflection densitometer and the neutral sensitometric parameters were calculated. The results are shown in TABLE 1. Coating (A) showed normal paper reflection densities while Coating (B) showed lower values because of the lower coating weight.

Rehalogenation -Coating 2

This strip was processed with the following cycle:

| | | | | |
|---|---|---|---|---|
| 1 | Soln (1) | RA4 developer | 45" | |
| 2 | Soln (5) | Sulphite fix | 45" | |
| 3 | | WASH | 30" | |
| 4 | Soln (4) | Peroxide bleach | 45" | -Rehalogenation |
| 5 | | WASH | 30" | |
| | | LIGHT FOG | 12" | (250 watt @ 15 cm) |
| 6 | Soln (1) | RA4 developer | 30" | |
| 7 | | WASH | 30" | |
| 8 | Soln (4) | Peroxide bleach | 45" | |
| 9 | | WASH | 30" | |
| 10 | Soln (5) | Sulphite fix | 45" | |
| 11 | | WASH | 60" | |

The reflection densitometry gave the parameters shown in Table 1. Table 1 shows substantially higher contrasts are obtained (especially in the blue layer) and would warrant further silver reductions. The higher Dmin results from incomplete removal of CD3 developing agent at stage 7.

TABLE 1

| | Dmin | | | Dmax | | | CONTRAST | | | SHOULDER | | | TOE | | |
|---|---|---|---|---|---|---|---|---|---|---|---|---|---|---|---|
| PAPER | R | G | B | R | G | B | R | G | B | R | G | B | R | G | B |
| A | 0.107 | 0.122 | 0.079 | 2.63 | 2.68 | 2.44 | 3.46 | 3.98 | 2.97 | 1.82 | 2.00 | 1.75 | 0.312 | 0.316 | 0.287 |
| B | 0.104 | 0.116 | 0.060 | 1.76 | 2.00 | 1.71 | 1.93 | 2.06 | 1.86 | 1.39 | 1.47 | 1.30 | 0.381 | 0.369 | 0.339 |
| C | 0.171 | 0.264 | 0.203 | 2.78 | 2.64 | 2.49 | 3.90 | 4.10 | 3.59 | 2.11 | 2.22 | 2.00 | 0.317 | 0.382 | 0.345 |

A Control Coating 1
B Coating 2
C REHALOGENATION (Coating 2)

EXAMPLE 2

Rehalogenation and RX

A multilayer colour photographic paper was coated (12.5 cm web), similar to currently available silver chloride colour paper with the following silver laydowns and grain sizes:

| | CYAN | MAGENTA | YELLOW | TOTAL |
|---|---|---|---|---|
| Grain Size (EGA microns) | 0.384 | 0.312 | 0.384 | |
| Silver (mg/m$^2$) | 32.3 | 37.7 | 53.8 | 123.8 |

Four strips of the coating were exposed to a four colour wedge,(giving red, green, blue and neutral exposures) for 0.1 sec on a sensitometer, utilising a filter pack containing a WRATTEN 2B plus 60M and 60Y cc filters.

The following developer was prepared:

| (6) | Developer | |
|---|---|---|
| | Demin water | 700 ml |
| | 1-hydroxyethylidene-1,1'-diphosphonic acid | 0.60 g |
| | diethyltriamine-pentaacetic acid | 2.0 ml |
| | KBr | 1 mg |
| | KCl | 0.50 g |
| | Diethylhydroxylamine (85% soln) | 4.0 ml |
| | Catechol disulphonate (Na salt) | 0.60 g |
| | 4-N-ethyl-N-(β-methanesulphonamido-ethyl)-o-toluidine sesquisulphate | 3.50 g |
| | $K_2CO_3$ | 25 g |
| | -Demin water to 1 Liter | |
| | -pH 10.3 (27° C.) | |

Processing

A number of processing cycles were carried out to illustrate the combination of rehalogenation and redox (RX) amplification. All processing was carried out at 32° C. and the first two steps were carried out on two KODAK H11 drum processors.

For simplicity the following abbreviations are used:

| | | |
|---|---|---|
| D(6)45" | = Developer (6) for 45 secs | (Drum 1) |
| F(5)30" | = Fix (5) for 30 secs | (Drum 2) |
| B(4)45" | = Bleach (4) for 45 secs | (2L Tank) |
| FOG | = Light fog (250 watt @ 15 cm) | |
| W | = Wash | |

The following four processing cycles were carried out:

(a) D(6)45"; F(5)30"; W30"; B(4)45"; FOG; D(6)45"; W30"

(b) D(6)45"; F(5)30"; W30"; D(6)45"; B(4)45"; W30"

(c) D(6)45"; F(5)30"; W30"; D(6)45"; B(4)45"; D(6)45"; W30"

(d) D(6)45"; F(5)30"; W30"; B(4)45"; D(6)45"; B(4)45"; D(6)45"; W30"

In processing cycles (a)-(d) the dye images were formed by both direct chromogenic development with (and without) rehalogenation and also by RX amplification where developer soaked paper was introduced to the bleach bath and where a bleached soaked paper was introduced into a developer bath. Silver (metal) and silver halide would be left in the dye image as follows:

| | | |
|---|---|---|
| In process | (a) | Ag° |
| | (b) | AgCl |
| | (c) | Ag° |
| | (d) | Ag° |

The amounts present were low because of the low silver coating weight. Leaving silver halide in the image (and no silver) was visually least objectionable.

The strips were read on an X-Rite densitometer and the parameters are listed in Table 2. The best sensitometry was obtained with cycle (d) i.e. using rehalogenation followed by three RX stages. This demonstrates the potential advantages of a multibath process.

TABLE 2

| PROCESS | Dmin | | | Dmax | | | CONTRAST | | | SHOULDER | | | TOE | | |
|---|---|---|---|---|---|---|---|---|---|---|---|---|---|---|---|
| | (Neutral Sensitometry) | | | | | | | | | | | | | | |
| CYCLE | R | G | B | R | G | B | R | G | B | R | G | B | R | G | B |
| A | 0.122 | 0.142 | 0.095 | 1.73 | 1.50 | 2.30 | 2.08 | 1.72 | 2.88 | 1.34 | 1.28 | 1.73 | 0.322 | 0.446 | 0.294 |
| B | 0.128 | 0.150 | 0.100 | 1.44 | 1.78 | 1.77 | 2.05 | 2.18 | 1.75 | 1.27 | 1.40 | 1.29 | 0.360 | 0.364 | 0.406 |
| C | 0.139 | 0.166 | 0.114 | 2.14 | 2.07 | 2.49 | 2.87 | 2.43 | 2.89 | 1.68 | 1.62 | 1.76 | 0.314 | 0.361 | 0.308 |
| D | 0.131 | 0.158 | 0.106 | 2.52 | 2.34 | 2.72 | 3.73 | 3.38 | 4.21 | 1.98 | 1.89 | 2.07 | 0.291 | 0.313 | 0.261 |

We claim:

1. A method of forming a photographic color image from an imagewise exposed photographic silver halide material containing at least one dye image-forming color coupler, said method comprising the following steps, in order:

A) treating said imagewise exposed photographic silver halide material with a first color developing agent, B) bleaching with a rehalogenating bleaching solution, and C) treating said bleached photographic silver halide material with a second color developing agent whereby the rehalogenated silver halide formed in step B is developed, steps B and C both being carried out one or more times, in sequence, after the initial step A, provided that:

1) when said imagewise exposed photographic silver halide material contains a silver bromide or silver bromoiodide emulsion, said rehalogenating bleaching solution contains chloride as the rehalogenating agent, 2) said photographic silver halide material is treated with a fixing solution comprising a sulfite fixing agent between steps A and B, or 3) said bleached photographic silver halide material is fogged using light or a chemical fogging agent between steps B and C.

2. The method of claim 1 wherein said photographic silver halide material has a total silver halide coating weight of less than 500 mg silver per $m^2$.

3. The method of claim 1 wherein said photographic silver halide material comprises an emulsion composed of at least 85% silver chloride.

4. The method of claim 1 wherein said sulfite fixing agent is present in said fixing solution in an amount of from 12 to 190 g/l.

5. The method of claim 4 wherein said sulfite is present in said fixing solution in an amount of from 20 to 125 g/l.

6. The method of claim 1 wherein said rehalogenating bleaching solution comprises hydrogen peroxide and has a pH of from 5 to 9.

7. The method of claim 6 wherein said rehalogenating bleaching solution comprises chloride ions.

8. The method of claim 6 wherein hydrogen peroxide present in said rehalogenating bleaching solution is carried over into step C so that redox amplification occurs.

9. The method of claim 6 wherein said first or second color developing agent is removed from said photographic silver halide material between steps B and C each time said steps B and C are carried out.

10. The method of claim 6 wherein said first or second color developing agent is present during said step B each time it is carried out so that redox amplification occurs.

11. The method of claim 1 wherein said photographic silver halide material is a multicolor photographic material comprising a support having thereon a yellow dye image-forming unit comprising at least one blue-sensitive silver halide emulsion layer having associated therewith at least one yellow dye-forming color coupler, at least one magenta dye image-forming unit comprising at least one green-sensitive silver halide emulsion layer having associated therewith at least one magenta dye-forming color coupler, and at least one cyan dye image-forming unit comprising at least one red-sensitive silver halide emulsion layer having associated therewith at least one cyan dye-forming color coupler.

12. The method of claim 1 wherein said photographic silver halide material has a total silver halide coating weight of less than 300 mg silver per $m^2$.

13. The method of claim 1 wherein said first and second color developing agents are the same.

14. A method of forming a photographic color image from an imagewise exposed photographic silver halide material containing at least one dye image-forming color coupler, said method comprising the following steps, in order:

A) treating said imagewise exposed photographic silver halide material with a first color developing agent, A-1) treating said developed photographic silver halide material with a fixing solution comprising a sulfite fixing agent, B) bleaching said fixed photographic silver halide material with a rehalogenating bleaching solution, C) treating said bleached photographic silver halide material with a second color developing agent whereby the rehalogenated silver halide formed in step B is developed, D) bleaching said photographic silver halide material with a rehalogenating solution, E) fixing said photographic silver halide material using a sulfite-containing fixing solution, and F) subjecting said photographic silver halide material to a wash or stabilization step, steps B and C both being carried out to one or more times, in sequence, after the initial steps A and A-1 and before steps D, E and F, provided that:

when said imagewise exposed photographic silver halide material contains a silver bromide or silver bromoiodide emulsion, said rehalogenating bleaching solution contains chloride as the rehalogenating agent.

15. The method of claim 14 further comprising a wash step between steps A-1 and B.

16. The method of claim 14 wherein the fixing agent used in step A-1 is sodium sulfite.

17. The method of claim 14 further comprising a step of fogging with light or a chemical foggant between steps B and C.

* * * * *